8/30/77 XR 4,044,832

United States Patent [19]

Richard et al.

[11] 4,044,832

[45] Aug. 30, 1977

[54] CONCENTRIC GRAVEL PACK WITH CROSSOVER TOOL AND METHOD OF GRAVEL PACKING

[75] Inventors: Charles A. Richard, Gretna; John Philip Barbee, Luling, both of La.

[73] Assignee: Baker International Corporation, Orange, Calif.

[21] Appl. No.: 718,151

[22] Filed: Aug. 27, 1976

[51] Int. Cl.[2] ..... E21B 33/12; E21B 43/04

[52] U.S. Cl. ..... 166/278; 166/51; 166/143; 166/307

[58] Field of Search ..... 166/278, 51, 276, 142, 166/143, 152, 185, 188, 181, 334, 307

[56] References Cited

U.S. PATENT DOCUMENTS

| | | | |
|---|---|---|---|
| 3,627,046 | 12/1971 | Miller et al. | 166/51 X |
| 3,710,862 | 1/1973 | Young et al. | 166/278 |
| 3,830,294 | 8/1974 | Swanson, Jr. | 166/278 X |
| 3,963,076 | 6/1976 | Winslow | 166/278 |
| 3,987,854 | 10/1976 | Callihan et al. | 166/278 |

*Primary Examiner*—Stephen J. Novosad
*Attorney, Agent, or Firm*—William C. Norvell, Jr.

[57] ABSTRACT

A packer with a liner assembly depending from it is packed off and anchored in well casing so that a screen portion of the liner assembly straddles casing perforations within a producing formation. An outer tubing string is lowered through the well casing and engaged with the packer to isolate the formation from well fluids above the packer and to provide a passage to the surface for the formation fluids.

A member having crossover fluid passages and external seals engageable with internal seal surfaces in the liner and packer is lowered through the outer tubing string into the liner and packer on an inner string. Fluid passages between the two strings, and between the two strings and the interior and exterior of the liner to control the flow of circulating, washing or acidizing fluids and for placement of gravel on the outside of the liner are selectively opened or closed by manipulation of the inner string.

15 Claims, 7 Drawing Figures

CONCENTRIC GRAVEL PACK WITH CROSSOVER TOOL AND METHOD OF GRAVEL PACKING

BACKGROUND OF THE INVENTION

1. Field of the Invention

The present invention relates to an apparatus and method for packing gravel within the bore of a subterranean well.

2. Description of the Prior Art

Of considerable magnitude in the production of hydrocarbons such as oil and gas from a producing well is the problem of sand flow into the well bore from unconsolidated formation. Production of sand with the flow of hydrocarbons will cause the well bore to gradually fill up with minute sand particles until production perforations in the casing and, oftentimes, the end of production tubing inserted therein are covered, resulting in a significant reduction in fluid production. In many instances, sand production will cause the well to die.

In addition to reduction of fluid production, flow of sand also may cause severe damage to equipment such as pumps, chokes and the like. In flowing wells, fluid velocity may be sufficient to scavenge sand within the well bore and produce it with the fluid hydrocarbon, resulting in holes being cut in the tubing and flow lines.

One well known means of controlling flow of sand into the well bore is the placement of gravel on the exterior of a slotted liner to filter sand produced with the oil or gas and thus prevent its entry into production tubing. The slotted liner or screen must be designed to prevent entry of the gravel itself into the production tubing.

The reverse circulation method of packing gravel provides for pumping the gravel down the well in the annulus between the production tubing and the well casing. The gravel is deposited on the outer periphery of the screen assembly while the fluid returns to the top of the well through the production tubing. A pressure buildup is noted at the surface and fluid pumping stopped when the gravel covers the screen. After gravel settlement, the tubing is disconnected from the screen assembly and pulled out of the hole.

Although other fluids have been used, treated and filtered production or nearby well or surface water is preferably used in most gravel packing processes during the cleaning and washing procedure. The water is treated to remove contaminants such as cement particles, scale, and other foreign material generally resulting from the circulation of water in the well bore. Because the volume in the annulus between the production tubing and the well casing may be as much as eight to 10 times greater than the volume of the production tubing, considerably more water must be used and thus treated and filtered if clean fluid is to be used in a reverse circulation process or method than is used in conventional wash down methods.

In order to provide a gravel pack apparatus which is more efficient than prior art apparatuses and, primarily, to drastically reduce the amount of fluid which must be used during a gravel packing process, crossover equipment has been developed for use with screen assemblies and high performance packers. Such equipment now has made it feasible to gravel pack using only a fraction of the volume of fluid heretofore utilized because the fluid is maintained within the tubing and is circulated only within the treatment zone which is isolated by the packing element of the packer.

Although such an apparatus has provided many advantages over the use of conventional prior art techniques, heretofore its use has been confining because it has not been able to be successfully utilized in high pressure wells which require the use of high density fluids, such as highly weighted muds instead of water. Heretofore, if such an apparatus were utilized in conjunction with the mud system, the screen as well as the gravel pack would become plugged, resulting in a severe limitation of hydrocarbon production therethrough.

It is, therefore, an object of the present invention to provide an apparatus and method for gravel packing utilizing concentric strings of tubing wherein the zone being gravel packed is completely isolated from the well control fluid (mud) during the gravel pack operation and may remain isolated from it, if desired, after completion of the gravel pack operation.

It is also an object of the present invention to provide an apparatus and a method which utilizes a crossover assembly with concentric strings of tubing to eliminate the necessity of pumping gravel in a high pressure well down the tubing-to-tubing annulus.

It is a further object of the present invention to provide an apparatus and method whereby flow paths into, through, and around a gravel pack screen can be altered and regulated by longitudinal manipulation of an internal tubing string within an outer tubing string.

It is a further object of the present invention to provide an apparatus and method for gravel packing wherein high pressures may be utilized during acidizing and squeezing of gravel into the formation.

Other objects of the present invention will be readily apparent from a reading of the Figures the specification below, and the claims.

SUMMARY OF THE INVENTION

The present apparatus for packing gravel within a well isolates the zone to be gravel packed from well fluid normally used to contain the well pressure. The apparatus utilizes two concentric tubing strings. The outer tubing string is connected or may be releasably connected to a packer which is set within the well casing with the liner assembly being attached to the packer and positioned adjacent to perforations within the well casing. The liner assembly comprises a production screen preferably long enough to cover or straddle substantially all casing perforations to be gravel packed. The inner tubing string carries a crossover assembly selectively positionable within the packer and liner assembly such that flow paths are established for washing the screen, squeezing acid into the formation, gravel packing the production zone, and, if desired, thereafter pumping mud down one of the tubing strings to kill the well. The invention also incorporates a method utilizing the apparatus as above described for selectively directing the flushing and gravel packing fluids through the tubing strings and into and from the annulus around the liner assembly, as well as the interior of the liner assembly.

DESCRIPTION OF THE PREFERRED EMBODIMENTS

Figure 1:
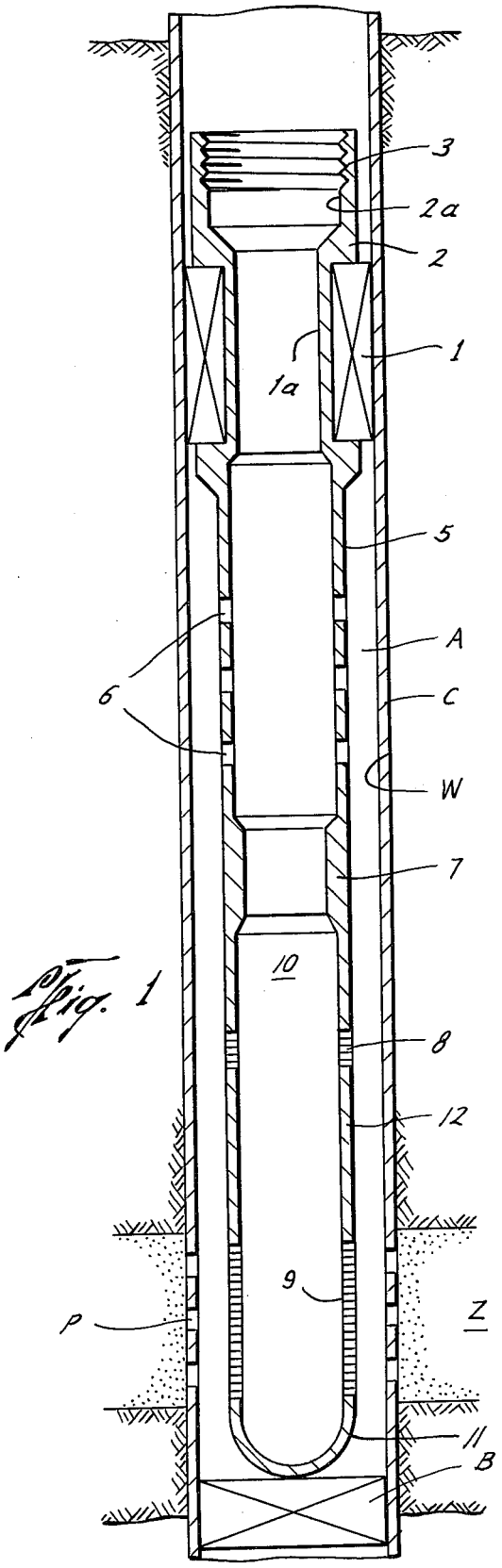
FIG. 1 is a longitudinally schematic drawing of a packer carrying a liner assembly, the packer being in sealed position above the production zone within the casing.
Figure 2:
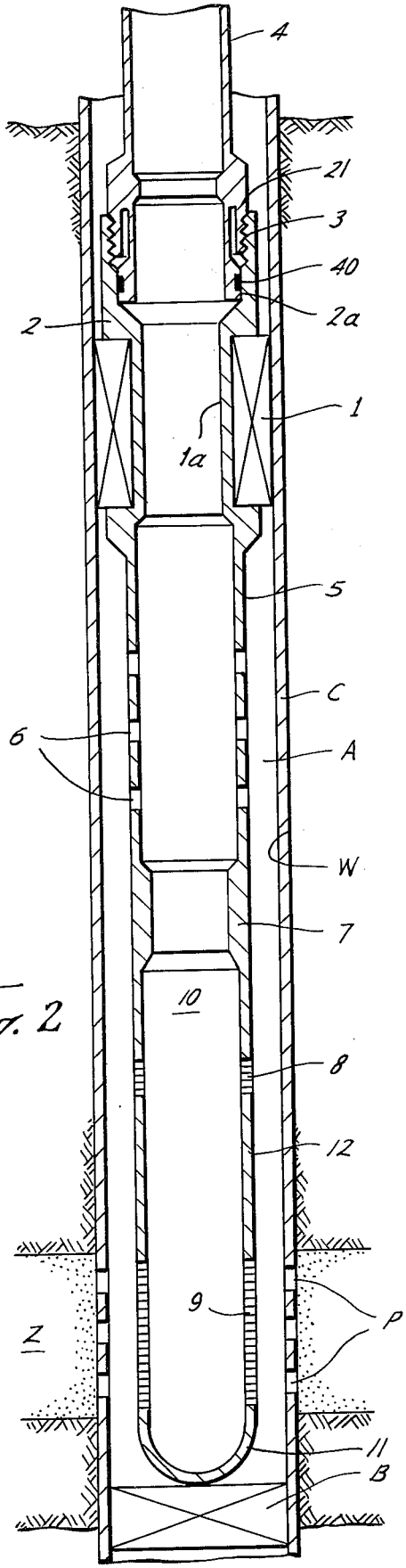
FIG. 2 is a similar drawing showing an outer tubular string sealingly engaged and detachably connected to the packer.

The apparatus disclosed in the drawings is used within a well bore W extending through a formation producing zone Z, a casing C having been suitably cemented or otherwise secured in place within the well bore. The casing has perforations P through which fluids from the producing zone can flow to the interior of the casing. A suitable bridge plug B is disclosed as having been set in the well casing a predetermined distance below the perforations, which serves to prevent fluid from the zone from flowing downwardly beyond the bridge plug, and which also acts as a locator for appropriately positioning a liner assembly 5 embodying one or more perforated portions or screens 9 with respect to the casing perforations.

The upper end of the liner assembly is secured to a suitable well packer 1. The particular packer or packer mechanism 1 utilized in the present invention may vary considerably in design, construction and operation. The packer will provide an interior surface or bore which serves as a sealing surface for the crossover tool described below. Preferably, the packer mechanism is designed to receive a latching mechanism at its upper end for utilization in connection of the outer tubular string to the packing mechanism. The packer also is adapted to be lowered in the well casing C and anchored in a packed-off condition therewithin against longitudinal movement in both upward and downward directions in a known manner. Suitable for use in the present invention are Model DA and FA packers manufactured and sold by Baker Oil Tools, Inc., and shown on pages 396 and 397, respectively, of the 1974–1975 Catalog of Baker Oil Tools, Inc.

The liner assembly 5 includes a series of circumferentially extending ports 6 for communication of the interior 10 of the liner assembly 5 with the annular area A between the liner assembly 5 and the casing C below the packer 1. At a longitudinal distance below the series of ports 6 is an internally extending seal receptacle 7 having a reduced internal diameter for receipt of companion seal members carried on the crossover assembly.

Below the seal receptacle 7 on the liner assembly 5 is a longitudinally extending perforated or screen member 8 for detecting completion of the gravel packing step as described below. Separated from the perforated or screen section 8 by a tubular member 12 is a second perforated or screen member 9 which straddles the perforations P within the production zone Z. The screens 8 and 9 permit communication of fluid between the interior 10 of the liner assembly 5 and the annular area A, but prevents particulate matter from entering the interior 10. Below the screen member 9 and terminating the liner assembly 5 at its lower end is a bull plug 11 which is seated on the bottom of the well or, as shown in the Figures on a reference point, such as a bridge plug B.

Figure 3:
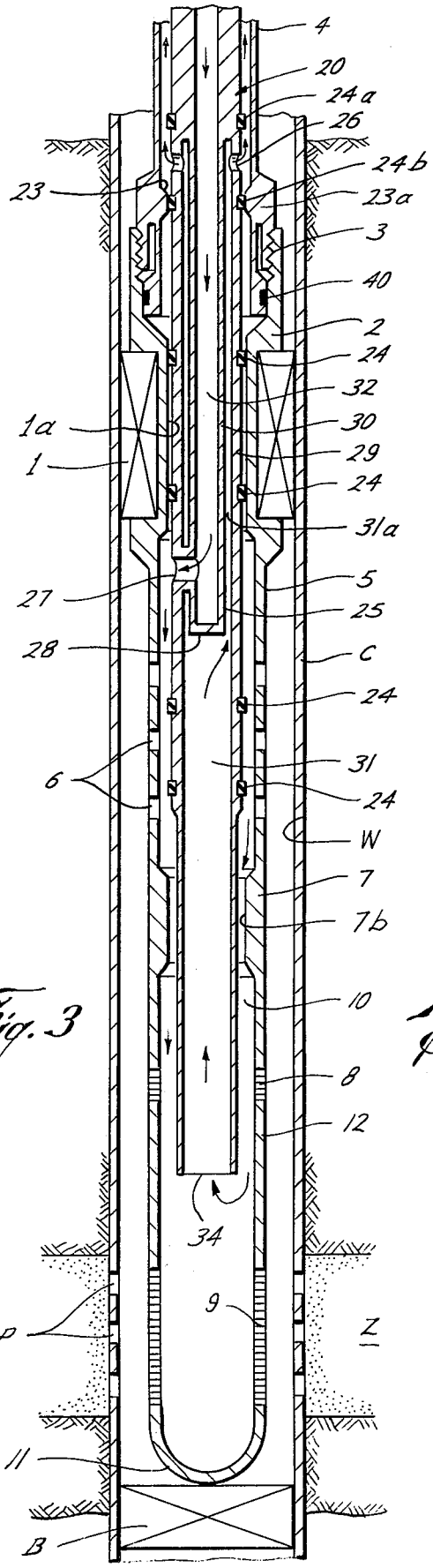
FIG. 3 is a similar drawing showing the crossover assembly carried by an inner tubular string with the crossover assembly sealingly engaged within the packer and extending into the liner assembly in position for displacing mud from inside the screen prior to gravel packing, the flow path being indicated by arrows.

Referring particularly to FIG. 3, a crossover assembly 20 is carried by an inner tubing string 25 which is inserted in the well within the first or outer tubing string 4. The crossover assembly 20 consists of an outer tubular member 29 long enough to extend from the top of the packer to below the screen member 9 and an inner tubular member 30 extending from the top of the crossover assembly to the vicinity of the ports 6 in the liner assembly 5. The interior of the inner tubular member 30 is open at its upper end to the interior of the inner tubing string 25. Its lower end 28 is closed except that a passageway or port 27 is provided through its side near the lower end which also extends through the adjacent side of the outer tubular member 29.

Elastomeric seal members 24 are mounted on the exterior of the outer tubular member 29 to effect selective sealing engagement within the bore 1*a* of the packer and the bore 7*b* of the receptacle 7. Ports 26 through the outer tubular member 29 are positioned between the uppermost seal member 24*a* and the second seal member 24*b* to provide a fluid passage between the exterior of the crossover assembly at this point, the annulus 31*a* between the inner and outer tubular members and thence to the lower end 34 of the outer tubular member. Thus when in a first position the lowermost seal 24 of the crossover assembly 20 is engaged with the wall 7*b* of the receptacle 7. (See FIG. 5) the passageway or port 27 in conjunction with port 6 in liner assembly 5 will provide fluid communication between the interior 32 of the crossover assembly 20 and the annulus A between the liner assembly 5 and the casing C.

Fluid can be pumped down the inner tubular string 25, through the ports 27 and 6 into the area A on the outside of the screen, through the screen 9 into the lower end of the crossover assembly 20 and upwardly through interior areas 31 and 31*a* and the outer tubular string 4 (shown in FIG. 5), with reverse circulation possible at any time. When the inner tubular member 25 is raised to a second position so that the lower seal members 24 on the crossover assembly 20 are engaged within the bore 1*a* of the packer 1, the port 27 will be above the packer and fluid may be pumped down the inner tubular string 25, through the port 27 and upwardly to the surface through the outer tubular string 4 (shown in FIG. 6) with reverse circulation possible at any time.

Figure 4:
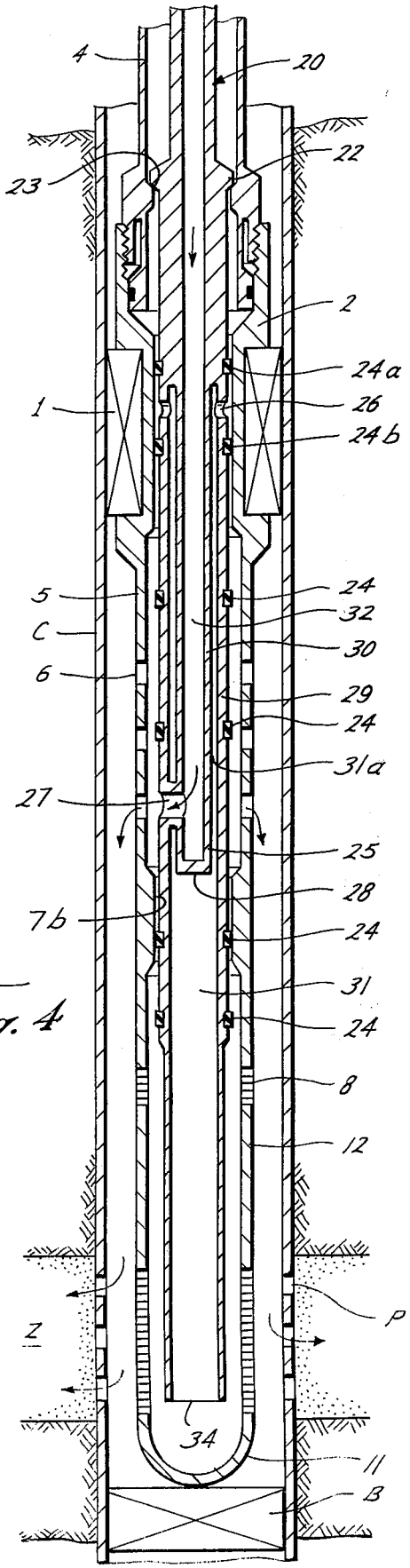
FIG. 4 is a similar drawing showing the crossover assembly in lowered position for squeezing of acid within the production zone.

Engagement of an abutment 22 formed by an enlargement of the crossover assembly 20 at its upper end with an internal shoulder in the anchored seal member 23*a* positions the crossover assembly in a third position as shown in FIG. 4. In this position ports 26 are sealed off in bore 1*a* of the packer 1 by seals 24*a* and 24*b* and no communication can take place between fluid in the annulus formed by the inner and outer tubing strings and fluid below the packer, but fluid can be pumped into the formation through the inner tubing string.

In a fourth position (FIG. 3) the crossover assembly can be raised until the lowermost seal member is slightly above the receptacle 7 whereby fluid may be pumped down the inner tubular string 25, through port 27, thence downwardly within the liner assembly 5 through the open receptacle 7 then upwardly through the open end 34 of the crossover assembly 20 and to the top of the well through the annulus between the inner and outer tubular strings.

OPERATION

In order to establish a base to support the gravel pack, a bridge plug B may be set below the lowermost end of the perforations P.

The packer or packing mechanism 1 with the seal receptacle 2 thereon and the liner assembly 5 therebelow is set at a predetermined depth in the well within the annular area A prior to initiation of the gravel packing operation. The setting mechanism is withdrawn and returned to the well surface. After the packing mechanism 1 has been set, the outer tubing string 4 is run in the well and is sealingly stabbed and latched into the seal receptacle 2, the latch members 21 of the outer tubular string 4 compatably engaging the threads 3 of the receptacle 2, the sealing engagement of the outer tubular string 4 and the receptacle 2 being assured by the circumferentially extending seal 40 carried by the outer tubular string 4 engaging the inner smooth wall **2*a* of the receptacle After the outer tubular string 4 has been engaged within the receptacle 2, the inner tubular string 25 is inserted at the top of the well through the outer tubular string 4, the inner tubular string 25 having affixed at its lower end the crossover assembly 20. The crossover assembly 20 carried by the tubular member 25 is lowered in the well until the abutment 22 contacts the shoulder 23. Thereafter, the inner tubular member 25 is raised a known and predetermined distance such that the lower seal members 24 carried by the first or outer tubular member 29 of the crossover assembly 20 are engaged along the inner wall 7*b* of the receptacle 7 of the liner assembly 5, with at least one of the series of seals 24 also being engaged within bore 1*a* of the packer mechanism 1. In this first or initial position, the port 26 of the crossover assembly 20 provides fluid communication to the top of the well and between the annular area of the outer and inner tubular strings 4 and 25 and the interior 31 of the tubular member 23 of the crossover assembly 20. Additionally, the first positioning of the crossover assembly 20 also permits the port 27 to provide fluid communication to the top of the well and between the interior 32 of the second or inner tubular member 30 and the interior of the liner assembly 5 above the receptacle 7 as well as the annular area A on the exterior of the liner assembly 5 by means of the port 6 on the liner assembly 5. The entire apparatus now is in condition for initiation of the gravel packing procedure As an initial step, the interior of the liner assembly 5 may be cleaned by first removing the lower seals 24 from engagement within the receptacle 7 by raising the inner tubing string 25. Thereafter, a flushing fluid is pumped from the top of the well through the inner tubular string 25 and the inner tubular member 30 of the crossover assembly 20, exiting the assembly 20 by means of port 27. The fluid continues downward circulation through the interior of the liner assembly 5 and re-enters the crossover assembly 20 by means of open end 34, thence through the interior areas 31 and 31*a* and thereafter to the top of the well through the outer tubular string 4**.

Thereafter, the inner tubing string 25 is lowered until the lower seals 24 are sealingly engaged within the receptacle 7. The flushing fluid is pumped from the top of the well through the annulus between the outer and inner tubular strings, entering the crossover assembly 20 through the port 26, thence downwardly through the crossover assembly out the open end 34 thereof and through the lower perforations of the liner assembly to the well bore, thence upwardly in the well liner assembly annulus and through the port 27 and the inner member of the crossover assembly to the top of the well. The flow path of this displacement and cleaning step is the reverse of that shown by the arrows in FIG. 5. While the crossover assembly is in the position as above described, an acidic solution is pumped down one of the tubing strings and around the screens 8 and 9 and washed back and forth to clean the screen perforations.

Upon completion of the step as described above, the inner tubular string 25 is lowered in the well until the shoulder 23 engages the abutment 22 at the top of the crossover assembly 20. When the crossover assembly 20 is in this position, the port 26 on the outer tubular member 29 will be within the bore **1*a* of the packer 1 and fluid will be prevented from traveling through said port because of the sealing engagement of upper and lower seal members 24*a* and 24*b* within the bore 1*a* of the packer member 1**.

Although the crossover assembly 20 has been lowered further within the liner assembly 5, the receptacle 7 still will engage at least one of the lower seals 24 on the outer tubular member 29 to prevent communication of fluid in the interior 10 of the liner assembly 5 below the receptacle 7 with fluid in the interior of the liner above it.

With the crossover assembly 20 positioned as described above, and as shown in FIG. 4, pressure is applied to the tubing strings and an acidic solution is squeezed into the perforations P. The acidic solution is pumped through the internal tubular string 25, exiting the crossover assembly 20 through the port 27, thence through the liner assembly 5 to the annular area A by means of ports 6. The flow path for this step is shown by the arrows in FIG. 4.

An alternative step in lieu of the foregoing may be achieved by leaving the crossover assembly 20 as shown in FIG. 3 while applying pressure to the tubing strings 25 and 4.

Figure 5:
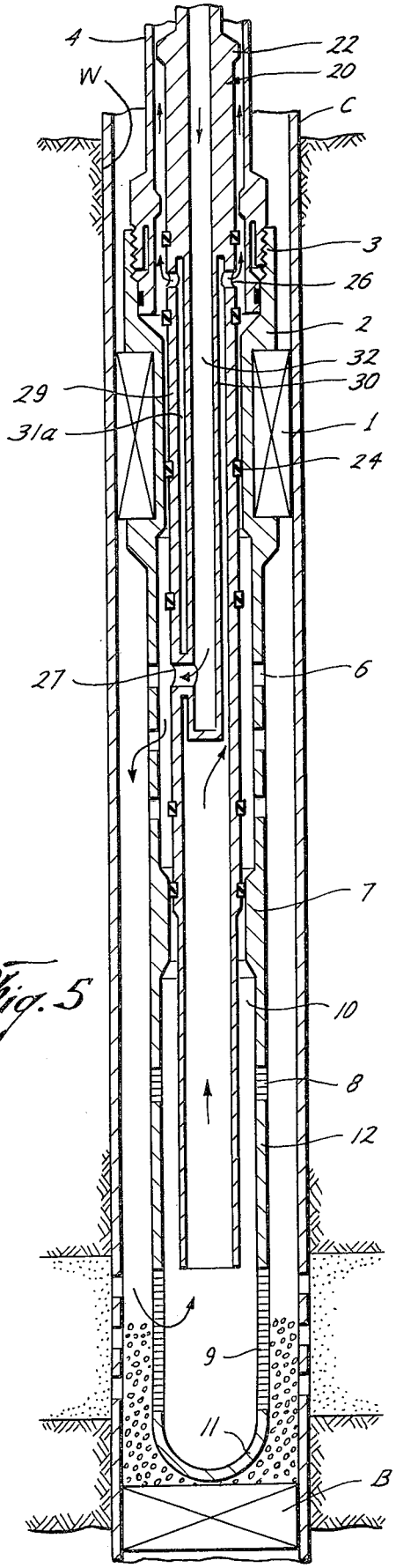
FIG. 5 is a similar drawing showing the crossover assembly in position for gravel packing the production zone.
Figure 6:
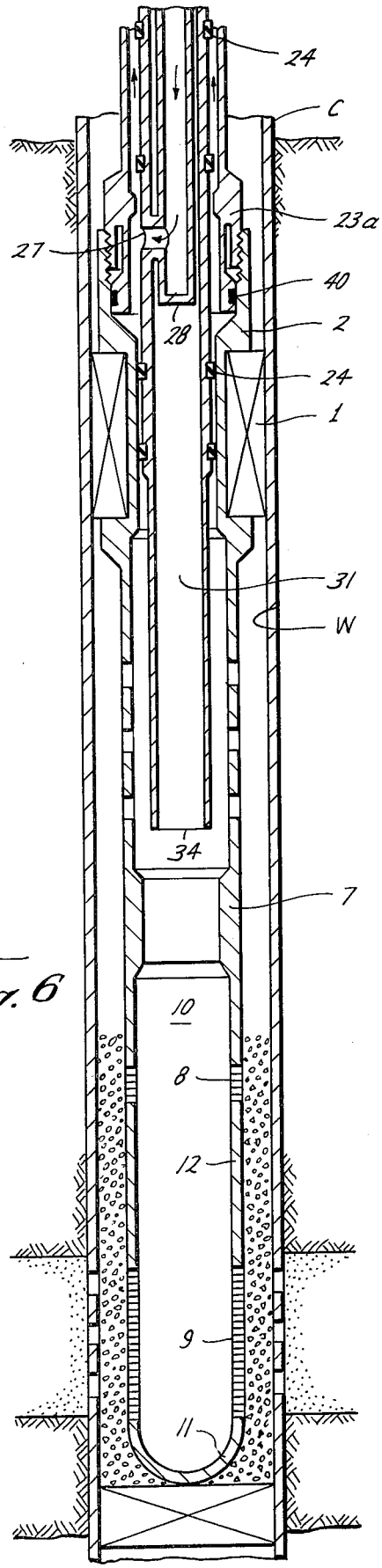
FIG. 6 is a similar drawing showing the production zone completely gravel packed and the crossover assembly in its fully raised position for pumping of mud to kill the well.

After cleaning the perforations P in one of the manners described above, the crossover assembly 20 is moved to a position within the liner assembly 5, as shown in FIG. 5. Thereafter, gravel carried by a suitable fluid is pumped down the inner tubular string 25 through the second or inner tubular member 30 of the crossover assembly 20, thence outwardly through ports 27 and ports 6. The gravel is deposited on the exterior of the liner assembly 5 adjacent to the perforations P and the perforated or screen member 9 while the fluid flows inwardly through the perforated or screened section 9 to the interior 10 of the liner assembly 5 and through the crossover assembly 20 through the open end 34, exiting the crossover assembly 20 through the ports 26 above the packer 1, thence to the top of the well through the outer tubular string 4. The pumping of gravel is continued and pressure is exerted within the inner tubular string 25 by closing a valve (not shown) on the outer string at the surface which will shut off the return path for the fluid. High pressure may then be applied to the inner string in order to force the gravel laden fluid into the formation so that gravel will fill the perforations and be tightly packed in any cavity behind them. Thereafter circulation is reestablished by opening the valve at the surface and gravel packing is continued until the annulus A is filled with gravel particles and until an increase in back pressure indicates that the tell tale perforated or screen member 8 has been covered with gravel.

Upon notation at the well surface of an increase in back pressure, the inner tubular string 25 and the crossover assembly 20 are raised until the lower seals 24 on the outer tubular member 29 of the crossover assembly 20 are withdrawn from the receptacle 7. Flushing fluid then can be circulated downwardly through the outer tubing 4 to clean the interior of the liner assembly 5 and is followed by enough gel solution to fill the interior of the liner assembly. The inner tubing string 25 may be moved to the position shown in FIG. 6 and the well killed with mud prior to removal from the well of the inner tubing string 25 and the crossover assembly 20 thereon. The hydrocarbons in the zone Z are produced through the perforations P, the screen or perforated member 9, thence upwardly through the interior 10 of the liner assembly 5 through the outer string 4 to the top of the well.

Figure 7:
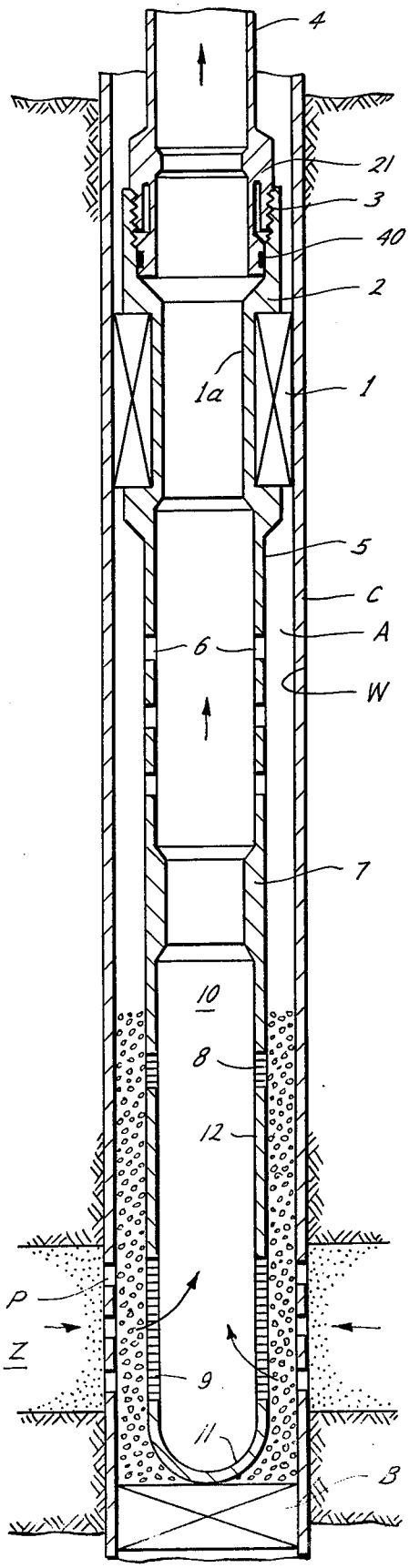
FIG. 7 is a similar drawing with the crossover assembly and the inner tubular string removed from the well and the production of fluid hydrocarbons from the zone being, as indicated by the arrows, through the production screen, the interior of the liner assembly, and through the second tubular string thereabove.

In lieu of killing the well, the crossover assembly 20 and the inner tubular string 25 may be removed from the well subsequent to completion of the gravel pack step (as shown in FIG. 5) by use of a snubbing unit with a blanking plug (not shown) being placed in the inner tubular string 25 adjacent to the top of the crossover assembly 20. The well is produced as described above and as shown in FIG. 7.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for use in a subterranean well having a production zone comprising: a packer set in the well above the zone, a tubular liner assembly adapted to depend from the packer within the production zone and to communicate with an outer tubular string sealingly engaged with the packer and extending to the top of the well, said liner assembly including a lower perforated portion through which fluid can flow between the well bore and the interior of the liner assembly and an upper ported portion through which fluid can flow between the well bore and the interior of the upper part of the liner assembly, crossover means positionable within said packer and liner assembly, and adapted for connection to an inner tubular member extending through the outer tubular string to the top of the well, said crossover means having spaced sealing means selectively coengageable with sealing surfaces within the packer and liner assembly upon movement of said crossover means longitudinally within said packer and liner assembly to prevent flow of fluid between said lower perforated portion and the annular area between said inner tubular member and said outer tubular string, and to selectively form separate fluid passages between said inner tubular member and said upper ported portion, said inner tubular member and said lower perforated portion and between said inner tubular member and said annular area.

2. An apparatus as defined in claim 1 wherein said crossover means comprises an elongated outer tube with said spaced sealing means consisting of an upper sealing means, one or more intermediate sealing means, and one or more lower sealing means mounted on its exterior, an inner tube having a closed lower end communicating at its upper end with the interior of said inner tubular member and through a lower crossover port at its lower end with the exterior of the outer tube at a position between said intermediate and lower seal means, said inner and outer tube defining an annular space communicating at its upper end with an upper crossover port leading to the exterior of said outer tube between said upper and said intermediate sealing means, and communicating at its lower end with the interior of said outer tube, and wherein said sealing surface within said liner assembly is positioned between said lower perforated and upper ported portions.

3. An apparatus as defined in claim 2 wherein said crossover means is longitudinally shiftable to selectively sealingly engage within said packer said upper and intermediate sealing means, solely was intermediate sealing means, or solely said lower sealing means.

4. An apparatus as defined in claim 2 wherein said crossover means is longitudinally shiftable to selectively sealingly engage within said packer said upper and intermediate sealing means with said packer or solely said intermediate means while said lower seal means are sealingly engaged with said sealing surface within said liner assembly.

5. An apparatus as defined in claim 2 wherein said crossover means is longitudinally shiftable to sealingly engage said intermediate sealing means within said packer with said lower seal means disengaged from said sealing surface within said liner assembly.

6. An apparatus as defined in claim 1 with stop means for locating said crossover means in said packer and liner assembly in a position to prevent flow of fluid between said lower perforated portion and the annular area between said inner tubular member and said outer tubular string.

7. An apparatus for use in a subterranean well having a production zone and well fluids comprising: a packer set in the well above the zone, a tubular liner assembly depending from the packer within the production zone and adapted to communicate with an outer tubular string releasably and sealingly engaged with the packer and extending to the top of the well, said liner assembly including a lower perforated portion through which well fluids can flow between the well bore and the interior of the liner assembly and an upper ported portion through which fluid can flow between the well bore and the interior of the upper part of the liner assembly, crossover means within said packer and liner assembly adapted for connection to an inner tubular string extending through the outer tubular string to the top of the well, said packer assembly, said liner assembly and said crossover means having spaced sealing means selectively engageable upon longitudinal movement of said crossover means relative to said packer and liner assembly to a first position to form a flow path to direct fluid flowing down the inner tubular string through said crossover assembly and said upper ported section to the well bore below the packer, through said lower perforated portion to the interior of said liner assembly, and upward to the top of the well through said crossover assembly and the annular area between said inner and outer tubular strings, and upon movement to a second position to direct said fluid to said well bore and said zone while preventing fluid from flowing upward to the top of the well in said annular area, and upon movement to a third position to direct said fluid through said crossover assembly, down through the interior of said liner assembly and upward to the top of the well through said crossover assembly and said annular area, and upon movement to a fourth position to direct said fluid through said crossover assembly to the top of the well through said annular area without passing below said packer.

8. A method of gravel packing a production zone in a subterranean well comprising the steps of lowering a liner assembly provided with a perforated portion on a packer in the well to locate the perforated portion of said liner assembly within the production zone, setting the packer in the well above the production zone, lowering an outer tubular string into the well and operatively connecting it to the packer, lowering a crossover assembly within the outer string on an inner tubular string to position the crossover assembly within the packer and liner assembly and to provide an annular space between said strings communicable with said perforated portion, said liner assembly having an upper passage above said perforated portion establishing communication between said inner tubular string and the exterior of said liner assembly below said packer, circulating fluid downwardly through said inner string into the region of the well below said packer and surrounding the liner assembly for upward flow through said annular space to the two of the well, and pumping gravel down said inner tubular string into the well surrounding the liner assembly to fill the annular space around the perforated portion of the liner assembly.

9. A method as defined in claim 8; effecting a first seal between said crossover assembly and said packer below said annular space to confine flow of circulating fluid along the entire external length of said perforated portion.

10. A method as defined in claim 9; shifting said inner string and crossover assembly longitudinally in the well to open said first seal, having a second seal between said crossover member and said packer assembly and a third seal between said crossover assembly and said liner assembly above said perforated portion and below said upper passage, said gravel being pumped from the top of the well through said inner string and upper passage into said annular space around said perforated portion with said second and third seals effective, the fluid in advance of the gravel flowing into and through said annular space toward the top of the well.

11. A method as defined in claim 9; prior to pumping gravel down said inner string, shifting said inner string and crossover assembly longitudinally in the well to open said third seal, pumping fluid down said inner string into said perforated portion for downward flow therethrough into said crossover member for upward flow therethrough into said annular space, longitudinally shifting said inner string and crossover assembly in the well to close said third seal, said gravel then being pumped from the top of the well through said inner string and upper passage into said annular space around said perforated portion with said second and third seals effective, the fluid in advance of the gravel flowing into and through said annular space toward the top of the well.

12. A method as defined in claim 11; shifting said inner string and crossover assembly longitudinally in the well after pumping gravel into the well to effect a seal between said packer and the lower portion of said crossover assembly to enable fluid to be circulated from said inner tubular string to said annular space without passing below said packer.

13. A method as defined in claim 12; withdrawing said inner string and crossover assembly from the well and producing the well through said outer tubular string.

14. A method for gravel packing a production zone in a well comprising the steps of: (a) running a well packing mechanism with a perforated liner assembly depending therefrom in the well and setting said mechanism in the well above the production zone; (b) running into the well a first tubular string for engagement with the packer assembly to provide a first flow path; (c) lowering through said first tubular string in a second tubular string having a crossover assembly affixed to its lower end; (d) longitudinally positioning the crossover assembly in a first position to circulate down the inner tubular string, through the interior of the liner assembly, thence upwardly through the outer tubular string to clean and displace the fluid in the liner assembly; (e) longitudinally positioning the crossover assembly to a second position to clean the exterior of the liner assembly and displace the fluid immediate the exterior of the liner assembly, and to provide fluid path means to wash the liner assembly with a washing solution; (f) longitudinally positioning said crossover assembly to a third position for squeezing of an acidic solution into the well formation and to insert gravel particles through casing perforations; (g) longitudinally positioning said crossover assembly to said second position to fill the annular space between said liner assembly and said well with gravel; (h) longitudinally positioning said crossover assembly to said first position to place a gel solution inside the liner assembly; (i) longitudinally positioning said crossover assembly to said fourth position to fill the tubular strings with a fluid to kill the well; and (j) producing the well through one of said tubular strings.

15. A method for gravel packing a production zone in a well comprising the steps of: (a) running a well packing mechanism with a perforated liner assembly depending therefrom in the well and setting said mechanism in the well above the production zone; (b) running into the well a first tubular string for engagement with the packer assembly to provide a first flow path; (c) lowering through said first tubular string a second tubular string having a crossover assembly affixed to its lower end; (d) longitudinally positioning the crossover assembly in a first position to circulate down the inner tubular string, through the interior of the liner assembly, thence upwardly through the outer tubular string to clean and displace the fluid in the liner assembly; (e) longitudinally positioning the crossover assembly to a second position to clean the exterior of the liner assembly, and to provide fluid path means to wash the liner assembly with a washing solution; (f) longitudinally positioning said crossover assembly to a third position for squeezing of an acidic solution into the well formation and to insert gravel particles through casing perforations; (g) longitudinally positioning said crossover assembly to said second position to fill the annular space between said liner assembly and said well with gravel; and (h) withdraw the inner tubular string from the well and produce the well through the outer tubular string.

* * * * *